United States Patent [19]

Gilli

[11] 3,963,133

[45] June 15, 1976

[54] PUBLIC WORKS MACHINE HAVING A REMOVABLE COUNTERWEIGHT AND METHOD OF DISMANTLING SAID COUNTERWEIGHT

[75] Inventor: Andre M. Gilli, Crepy-en-Valois, France

[73] Assignee: Societe Anonyme: Poclain, Le Plessis -Belleville, France

[22] Filed: Jan. 7, 1975

[21] Appl. No.: 539,181

[30] Foreign Application Priority Data

Jan. 16, 1974 France ..... 74.01476

[52] U.S. Cl. ..... 214/142; 212/49

[51] Int. Cl.[2] ..... E02F 9/18

[58] Field of Search ..... 214/142; 280/150 E; 212/48, 49

[56] References Cited

UNITED STATES PATENTS

| | | | |
|---|---|---|---|
| 2,068,397 | 1/1937 | Chapman | 212/48 |
| 2,130,487 | 9/1938 | Foley | 212/49 |
| 2,408,500 | 10/1946 | West | 212/49 |
| 2,820,556 | 1/1958 | Davis | 214/142 |
| 3,653,486 | 4/1972 | McLean et al. | 214/142 |
| 3,726,416 | 4/1973 | Pottorff et al. | 212/48 |

FOREIGN PATENTS OR APPLICATIONS

| | | | |
|---|---|---|---|
| 1,072,910 | 6/1967 | United Kingdom | 212/49 |

*Primary Examiner*—Robert J. Spar
*Assistant Examiner*—Ross Weaver
*Attorney, Agent, or Firm*—Lewis H. Eslinger; Alvin Sinderbrand

[57] ABSTRACT

This invention relates to a public works machine comprising a frame, a working attachment, a counterweight and auxiliary jib moving above the counterweight and coupled to the working attachment.

This auxiliary jib is provided with a guide member for a flexible connection means, said member being disposed above the counterweight, whilst such a connection means connects the counterweight to that part of the working attachment which is movable with respect to the part directly coupled to the frame by abutting on the guide member, constituting a link for handling said counterweight.

One application of the present invention is the providing of a high power hydraulic shovel with a dismountable counterweight.

5 Claims, 4 Drawing Figures

Figure 1:
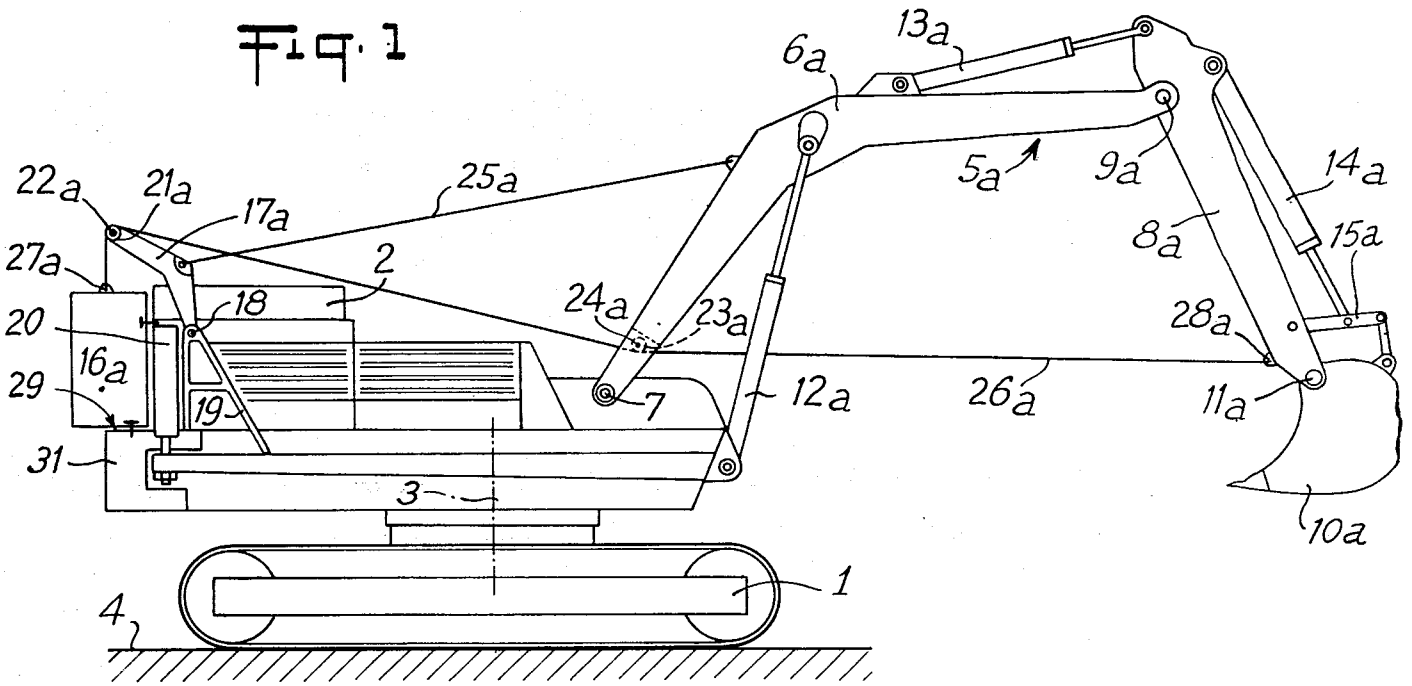

PUBLIC WORKS MACHINE HAVING A REMOVABLE COUNTERWEIGHT AND METHOD OF DISMANTLING SAID COUNTERWEIGHT

The present invention relates to a public works machine having a removable counterweight and to a method of dismantling said counterweight.

It is known that the majority of public works machines, hydraulic shovels, cranes, etc. are provided with counterweights which make it possible to balance the machine provided therewith and to avoid its tipping over under the effect of the load coupled to the working attachment.

As the dimensions of the machines increase, the total weight exceeds the maximum loads permitted by the road-traffic regulations and the need to dismantle the counterweight is manifest.

Such a dismantling has hiterto meant a long operation requiring the presence of an auxiliary handling machine for manoeuvring the mass of the counterweight.

The invention intends to remedy these drawbacks by proposing a simple and inexpensive adaptation of the machine, enabling said machine to cooperate with the dismantling of its own counterweight. To this end, the invention also proposes a particular method of carrying out the recommended adaptation.

The invention therefore firstly has for its object a public works machine constituted by:

a frame, a working attachment whose position with respect to the frame is adjustable, whose structure may undergo change and which extends in front of said frame, a counterweight disposed to the rear of the frame, and an auxiliary jib which moves above this counterweight and is connected to the working attachment by a first connection means of constant length, such as a bar, cable, etc.

In addition, the auxiliary jib is provided, in a manner known per se, with a guide member for a second flexible connection means, said member being disposed above the counterweight. Such a second flexible connection means connects the counterweight to that part of the working attachment which is movable with respect to the part directly coupled to the frame, by abutting on the guide member, constituting a link for handling said counterweight.

This second flexible connection means is advantageously of constant length, and may be a cable, chain or the like.

Another member for guiding the second flexible connection means is mounted on that part of the working attachment which is directly coupled to the frame.

The working attachment comprising, in manner known per se, a main jib articulated on the frame about a first axis, the return member is mounted to rotate on the auxiliary jib about a second axis parallel to said first axis.

The method of dismantling a counterweight from the above-mentioned machine is such that the deformation of the working attachment is so controlled as to pull the second flexible connection means and to raise the counterweight with respect to the frame, the counterweight is moved away from the rear face of the frame by modifying the position of the working attachment with respect to the frame, then the working attachment is further deformed so as to lower the counterweight with respect to the frame until it is placed on a support, e.g. the ground.

The invention will be more readily understood on reading the following description will reference to the accompanying drawings, in which:

FIGS. 1 to 4 are elevational views of the same public works machine according to the invention, in four different configurations.

The elements of the machine are provided, in the four Figures, with the same reference numerals. For those elements whose position is altered, this number is followed by the index *a*, *b*, *c*, *d* respectively, corresponding to the configurations shown in FIGS. 1, 2, 3, 4.

Referring now to the drawings, FIG. 1 shows a hydraulic shovel provided with a chassis 1 on endless tracks, and with a turret 2 mounted to rotate on said chassis 1 about a vertical axis 3. The chassis 1 rests on the ground 4.

This shovel comprises a working attachment 5*a* constituted by a jib 6*a* articulated on the turret 2 about a horizontal transverse axis 7, by a balance beam 8*a* articulated on the jib 6*a* about an axis 9*a* parallel to the axis 7, and by a bucket 10*a* articulated on the balance beam 8*a* about an axis 11*a* which is also parallel to axis 7. Jacks 12*a*, 13*a*, 14*a* are coupled respectively between the turret 2 and jib 6*a*, between jib 6*a* and balance beam 8*a*, and between balance beam 8*a* and the linkage 15*a* for manoeuvring the bucket 10*a*, in order to allow adjustment of the relative positions of these elements.

A counterweight 16*a* is fixed to the turret 2 opposite the working attachment 5*a* with respect to axis 3. The counterweight 16*a* is in fact a complementary counterweight to a main counterweight 31. This counterweight 31 is itself fixed to the turret 2 and comprises an upper face 29 on which counterweight 16*a* rests. An auxiliary jib 17*a* is articulated about an axis 18 on a support 19 disposed to the rear of the turret 2. In fact, the auxiliary jib 17*a* comprises two pins which are introduced on two forks fast with the ends of the support 19, and which thus allows the assembly to roate about axis 18. By way of indication, there is fixed to the support 19 the radiator 20 of the "Diesel" type motor of the shovel.

A pulley 21*a* is mounted to rotate about an axis 22*a* at the end of the auxiliary jib 17*a*, whilst another pulley 23*a* is mounted to rotate about an axis 24*a* on the main jib 6*a*, near axis 7. A cable 25*a*, of constant length, connects the auxiliary jib 17*a* to the main jib 6*a*, whilst another cable 26*a* of likewise constant length, connects an attachment 27*a*, fast with counterweight 16*a* to an attachment 28*a*, fast with the balance beam 8*a*, this cable passing over the guide pulleys 21*a* and 23*a*.

In the configuration of FIG. 1, the main jib 6*a* is so raised that, the counterweight 16*a* being fixed to the support 19 and the cable 25*a* being stretched, the pulley 21*a* is disposed perpendicularly above the attachment 27*a*. Furthermore, the balance beam 8*a* is placed in a position, with respect to the jib 6*a*, which is midway between the two extreme positions, that is to say said balance beam being entirely folded under the main jib, and said balance beam being disposed in line with this main jib. In position 8*a* of the balance beam, the cable 26*a* is stretched.

Figure 2:
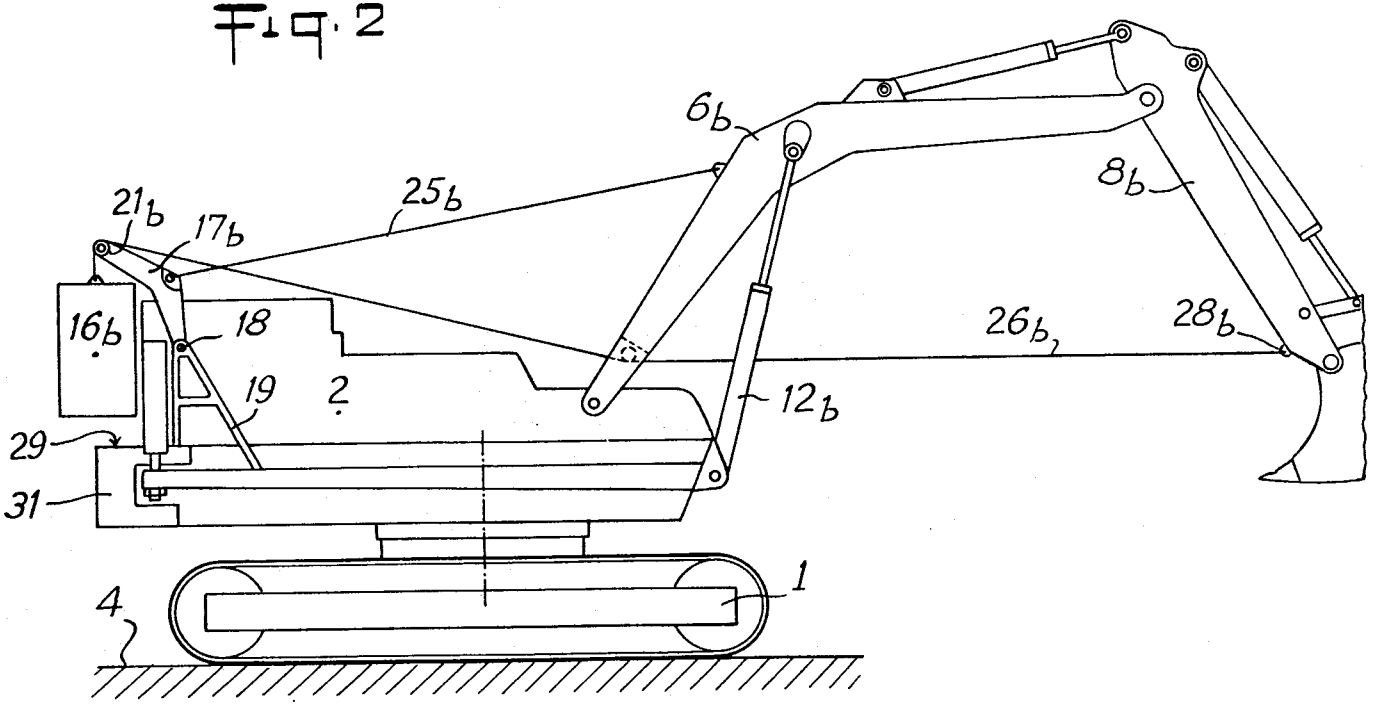

To pass from the configuration of FIG. 1 to that of FIG. 2, the means for fixing the counterweight to the support 19 must of course be removed. The cable 26*a* which is already stretched makes it possible for the counterweight 16*a* to be supported. It is then that the balance beam is extended with respect to the main jib. The main jib, auxiliary jib and cable connecting them conserve their respective initial positions 6*a*, 17*a* and 25*a*, although they are referenced 6*b*, 17*b* and 25*b*. On the other hand, the balance beam moves away from the turret 2 and comes to position 8*b*. The fastening which is fast therewith, comes to position 28*b*, having drawn the cable which is fixed thereto and which comes to 26*b*. The pulley 21*b* is disposed in the same position as pulley 21*a* with the result that the displacement of the cable 26*b* causes the counterweight to rise and come into position 16*b* and its underface is disengaged from the support 29.

Figure 3:
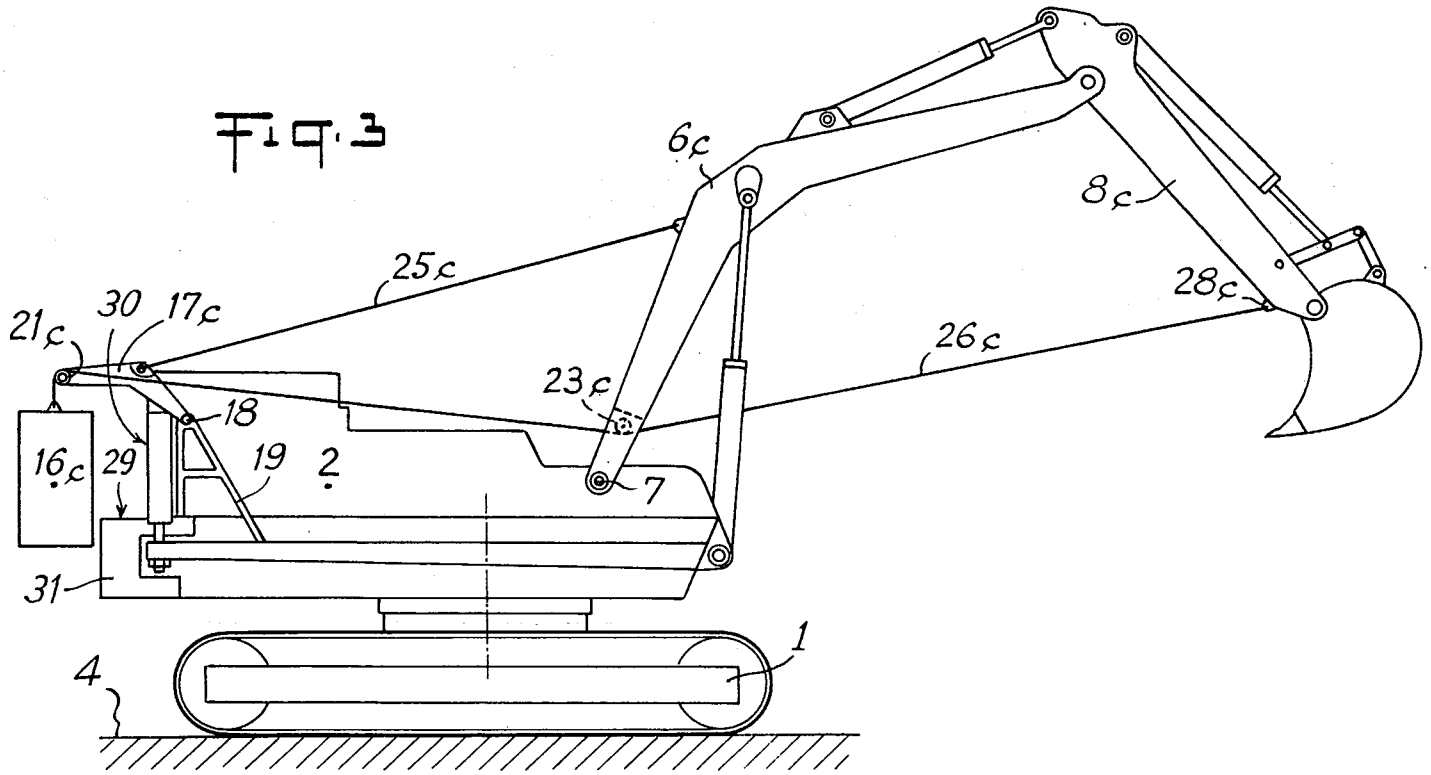
Figure 4:
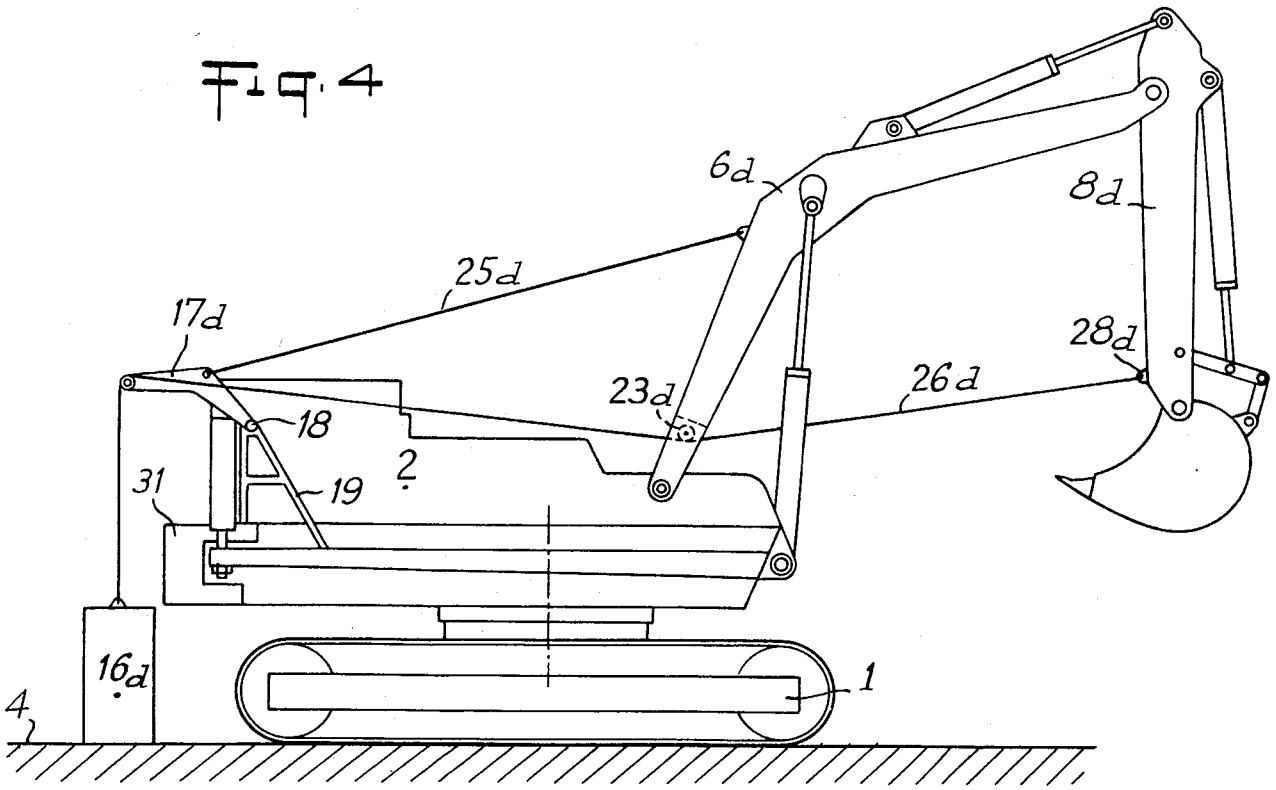

The third phase of dismantling consists in passing from the configuration shown in FIG. 2 to that of FIG. 3, i.e. in disengaging the counterweight from the rear face 30 of the turret. To this end, the assembly constituted by the main jib 6*b*, balance beam 8*b* and bucket is pivoted about axis 7, thus lifting the jib which comes to 6*c*, the balance beam which arrives at 8*c* and the bucket. The cable connecting the auxiliary jib to the main jib comes to position 25*c*, in which position the auxiliary jib inclines towards the rear of the turret, at 17*c*, causing the pulley 21*c* to move away from the face 30. The counterweight has come into position 16*c* and is disengaged from the face 30, being suspended above ground 4. The cable connecting the counterweight to the balance beam has come to position 26*c*, attached to said balance beam at 28*c*.

It is then sufficient to lower the counterweight until it rests on the ground 4 at 16*d* to terminate the dismantling operation. To this end, the main jib being at 6*d* in the same position as 6*c*, the balance beam is folded under this jib, bringing it from position 8*c* to position 8*d*. The approaching of the fastening 28*d* towards turret 2 causes the cable which is fixed thereto to move from 26*c* to 26*d*. The auxiliary jib 17*d* and the cable 25*d* are in positions identical with those, 17*c* and 25*c*, respectively, of the configuration of FIG. 3. The counterweight is therefore lowered onto the ground.

Of course, the counterweight may be mounted again by carrying out the above-mentioned manoeuvres in the reverse order.

The advantage of the disposition described resides essentially in the possibility of dismantling and remounting the counterweight, employing only the installed capacity of the machine and its working attachment.

To be noted is the simplicity of the adaptation which does not necessitate any particular operation, and resorts only to two cables of constant length.

The presence of the pulley 23*a* makes it possible to obtain a sufficiently long distance of the fastening 27*a* from the counterweight and is advantageous on this point. However, it is not always necessary.

Finally, it will also have been understood that, to carry out the method according to the invention, the machine must be provided with a working attachment 5*a*, but that, as this condition is obviously always fulfilled, this working attachment may be one of numerous known types. A machine provided with a telescopic jib, such as in particular a crane, could therefore carry out the method which has been described.

The disposition hereinbefore described is particularly advantageous on certain machines in which the counterweight or counterweights are of such a mass that the dismantling of the working attachment, whilst the counterweights are still fixed to the machine, brings about an unbalance of the machine, which sometimes risks tipping over due to its counterweights. In the machine which has been described, or similar machines, the dismantling of the counterweights being effected by using the working attachment, necessarily precedes the dismantling of said equipment so that, when this latter is itself dismantled, there is no longer any risk of tipping over. The proposed disposition therefore improves the safety of use of the machine provided therewith.

What is claimed is:

1. A public works machine comprising, a frame, a first jib element movably mounted on said frame, means for varying the position of said first jib element with respect to the frame, said jib element extending from one side of said frame, a beam element mounted on said first jib element for movement with respect to said first jib element, means for moving said beam element with respect to said jib element, a counterweight associated with said frame on the side thereof opposite said first jib element, an auxiliary jib element pivotally mounted on said frame adjacent said counterweight; a first connection member of constant length connected between said first jib element and said auxiliary jib whereby movement of said first jib is followed by movement of said auxiliary jib; said auxiliary jib including means for guiding a flexible element, said guiding means being located on the auxiliary jib above the counterweight, and a flexible connection element operatively connected between the counterweight and said beam element and guided on said auxiliary jib by said guide means, whereby said counterweight will move in response to movement of said jib and beam elements by their associated moving means.

2. A public works machine as claimed in claim 1 wherein said flexible connection element comprises an elongated cable of constant length between the counterweight and said beam.

3. A public works machine as claimed in claim 2, wherein said first jib element includes means for guiding the flexible cable.

4. A public works machine as claimed in claim 3, wherein the first jib element is pivotally mounted on the frame for pivotal movement about a first axis, the guide means on said auxiliary jib being mounted to rotate on the auxiliary jib element about a second axis parallel to said first axis.

5. A public works machine comprising, a frame, a first jib element pivotally mounted on said frame for pivotal movement in a vertical plane about at least one horizontal axis of rotation; means for pivoting said first jib element on the frame; said jib element extending from one side of the frame; a beam element pivotally mounted on said first jib element for pivotal movement with respect to said first jib element in the same vertical plane; means for pivoting said beam element with respect to said first jib element; a counterweight associated with said frame on the side thereof opposite said first jib element; an auxiliary jib element pivotally mounted on said frame adjacent said counterweight on a horizontal axis for movement in substantially the same vertical plane as said jib and beam elements; a first flexible cable of fixed length connected between said first jib element and said auxiliary jib whereby movement of said first jib is followed by movement of said auxiliary jib; a second flexible cable of fixed length operatively connected between said counterweight and said beam element; and a cable guide roller rotatably mounted on said auxiliary jib directly above said counterweight for guiding said second cable during movement of said jib and beam elements, whereby said counterweight will move in response to movements of said jib and beam elements by their associated pivoting means.

* * * * *